US005290104A

United States Patent [19]

Sengewald

[11] Patent Number: 5,290,104

[45] Date of Patent: Mar. 1, 1994

[54] FOIL BAG

[75] Inventor: Karl-Heinz Sengewald, Halle/Westf., Fed. Rep. of Germany

[73] Assignee: Karl-H. Sengewald GmbH & Co. KG, Fed. Rep. of Germany

[21] Appl. No.: 965,616

[22] Filed: Oct. 22, 1992

Related U.S. Application Data

[63] Continuation of Ser. No. 748,620, Aug. 22, 1991, abandoned.

[51] Int. Cl.[5] ..... B65D 33/06

[52] U.S. Cl. ..... 383/25; 206/554; 383/37; 383/67

[58] Field of Search ..... 206/390, 554; 383/25, 383/37, 67, 28, 21; 493/226

[56] References Cited

U.S. PATENT DOCUMENTS

| | | | |
|---|---|---|---|
| 1,524,399 | 1/1925 | Krueger | 493/226 |
| 3,015,918 | 1/1962 | Schoen | 383/67 X |
| 3,128,035 | 4/1964 | Tewles | 493/226 |
| 3,147,673 | 9/1964 | Hilton | 493/226 |
| 3,300,120 | 1/1967 | McColgan | 383/67 X |
| 3,348,760 | 10/1967 | Hinsken et al. | 383/67 X |
| 3,348,761 | 10/1967 | Vetter | 383/28 |
| 3,484,037 | 12/1969 | Kugler | 383/104 |
| 3,525,468 | 8/1970 | Kamins et al. | 383/28 |
| 3,732,661 | 5/1973 | Goldgerger et al. | 383/25 |
| 4,252,269 | 2/1981 | Peppiatt | 383/25 |
| 4,550,439 | 10/1985 | Peppiatt et al. | 383/28 |
| 4,764,030 | 8/1988 | Humphrey | 383/37 |
| 4,765,381 | 8/1988 | Castle | 383/67 X |
| 4,849,090 | 7/1989 | Case et al. | 706/390 |
| 4,854,733 | 8/1989 | Schwinn | 383/25 |
| 4,867,575 | 9/1989 | Wood | 383/25 |
| 4,902,140 | 2/1990 | Branson | 383/25 |
| 4,938,608 | 7/1990 | Espinosa | 383/37 |

FOREIGN PATENT DOCUMENTS

| | | |
|---|---|---|
| 8507919.7 | 3/1985 | Fed. Rep. of Germany . |
| 8007935 | 4/1980 | France . |

*Primary Examiner*—Allan N. Shoap
*Assistant Examiner*—Christopher J. McDonald
*Attorney, Agent, or Firm*—Diller, Ramik & Wight

[57] ABSTRACT

A foil bag has its upper end provided with a seam weld (14) interconnecting all of the bag walls and having the handle ledge (16a) of a handle (16) welded to its outer side. The handle (16) is made from a flexible foil material. In a foil bag line consisting of successive foil bags (12), the handle (16) of one respective foil bag overlaps the adjacent foil bag. The handles consist of a bendable foil material so that the foil bag line can be guided about processing and pressure rollers. The handles (16) are welded to seam welds (14) connecting the two side walls.

8 Claims, 4 Drawing Sheets

FIG.2
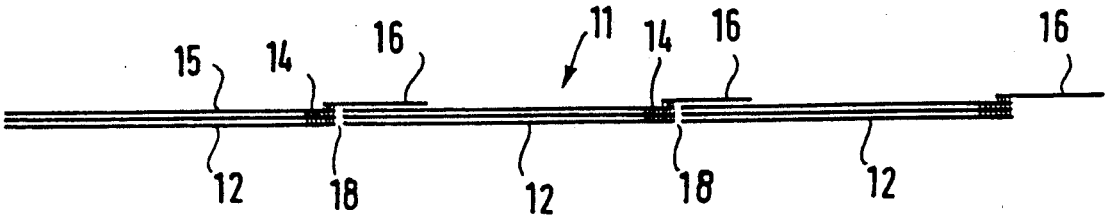
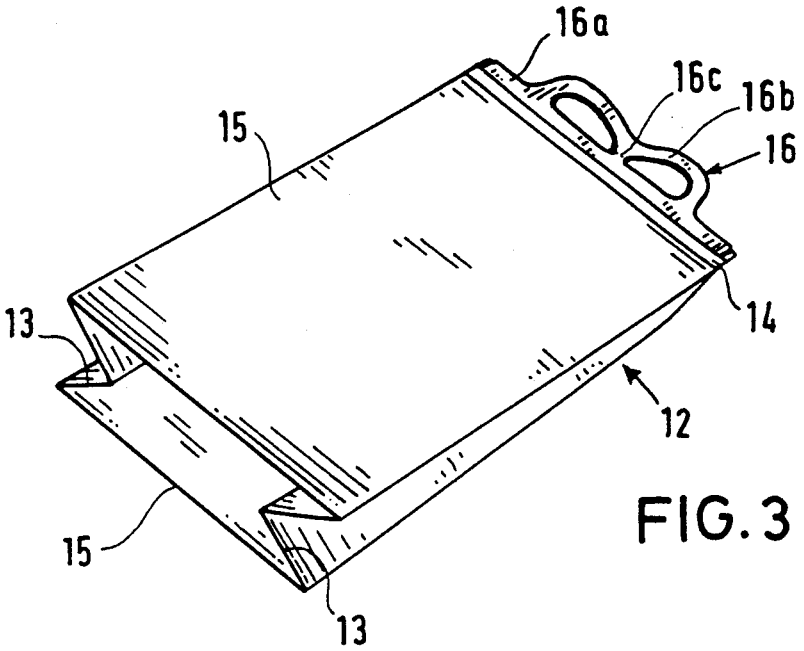
FIG. 3
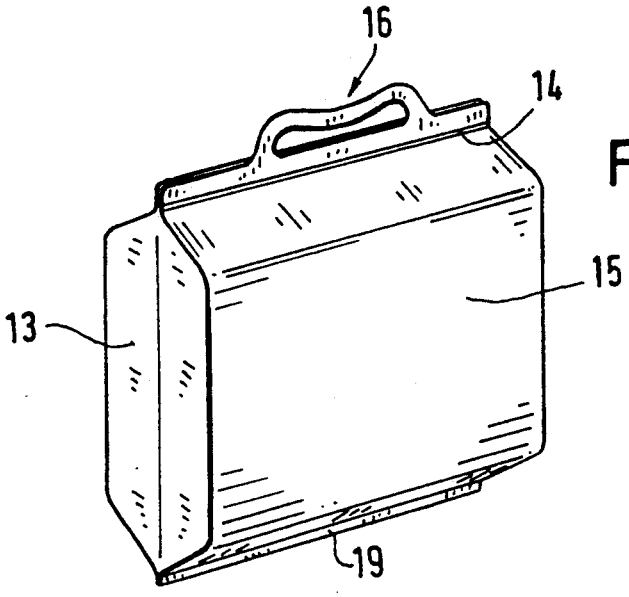
FIG.4

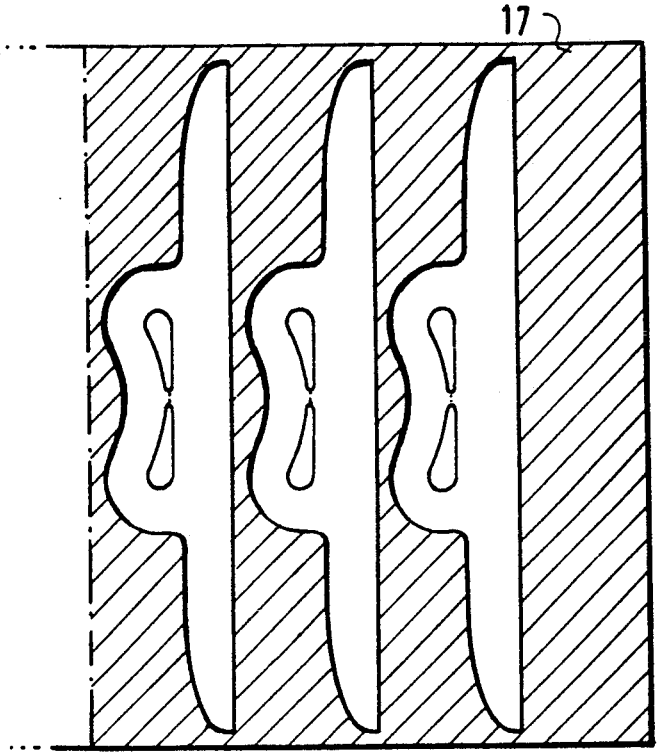
FIG.5
FIG.7
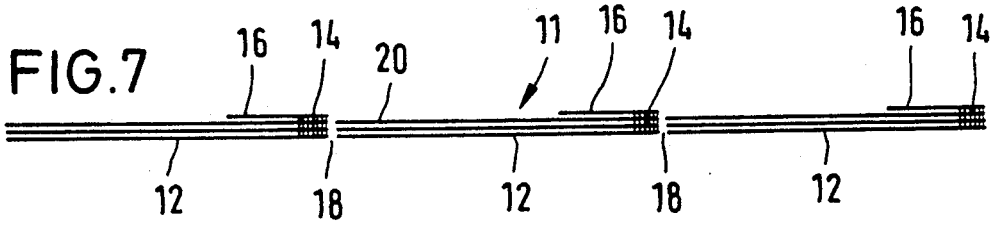
FIG.8
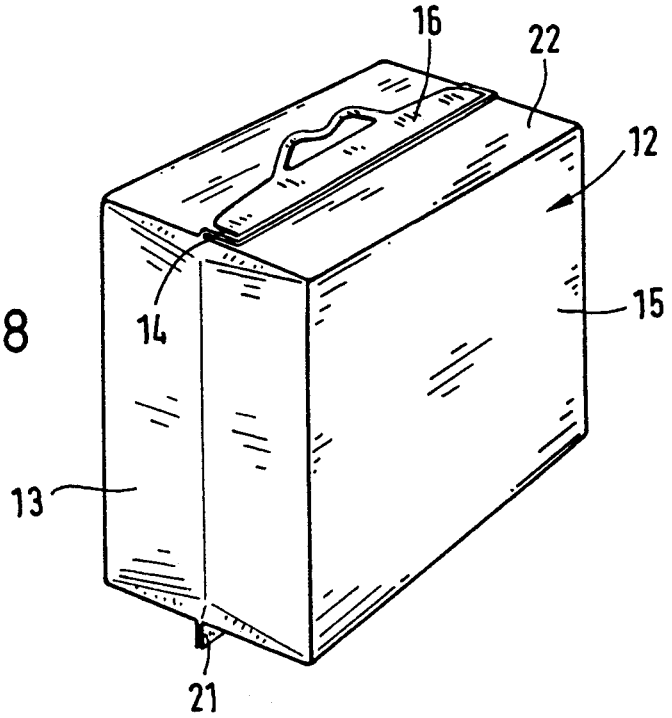

FOIL BAG

This application is a continuation of application Ser. No. 07/748,620, filed Aug. 22, 1991.

BACKGROUND OF THE INVENTION

The invention is directed to a foil bag with a handle. According to known practice, products such as baby diapers can be packed in foil bags provided with a handle for carrying. The handle is punched from a head portion of the foil bag which has been separately welded into a flat shape. While the foil bag is provided as a side-folds bag and can be widened to provide a large-volume filling chamber, the head portion, limited by two transverse seam welds, is flat. Due to the head portion, a considerable length of the foil hose is consumed for the handle so that, with each bag, a large part of the foil hose length cannot be used for packing space. Accordingly, foil consumption is undesirably high.

Further, foil bags are known which have handles welded thereto. Such foil bags are either open shopping bags, with both of their side walls having a handle of their own, or closed foil bags having a rigid handle. It is a disadvantage of rigid handles that the foil bags, while passing through a bag producing machine or a printing machine, cannot be guided around the rollers so that manufacture of such bags is difficult. Normally, these bags can be handled only as individual bags and not as a coherent bag line adpated to be wound up for forming a bag roll.

In a bag line of filled foil bags known from French Patent application 2,480,243, the bag material, consisting of two walls, has a third ply welded thereon. The third ply is punched out for forming a hanger or suspension flap. Remaining portions of this third foil ply are arranged at both sides of the bag, namely along the top seam and the bottom seam. For hanging up the bag, the hanger flap is bent by 180°, thus projecting beyond the top seam of the bag. In this known bag, a continuous foil sheet is required for producing the hanger flap, involving high material consumption.

In a foil bag disclosed by German Gebrauchsmuster G 85,07,919, two handle portions are welded to the side walls. These handle portions are bent backwards, and after filling the bag, they are set into an upright position and thus are combined into a handle. In this bag, there is a risk that the bag material will tear apart at the weld connections to the handle portions.

SUMMARY OF THE INVENTION

It is an object of the invention to provide a foil bag with handle which, while making good use of the foil material for the loading chamber, can be produced in an easy and inexpensive manner and, during manufacture and processing thereof, can pass through normal bag pro-ducing and printing machines.

In the foil bag of the invention, the handle consists of a separate foil portion being welded to a web seam of the bag. The foil material is flexible and does not interfere with the guided movement of the bag around guide or processing rollers. A particular advantage of this invention consists in that the handle can consist of a material which is different from that of the bag walls. Thus, for example, the handle can be made from inexpensive recycled material. Also the thickness of the foil material of the handle can differ from the thickness of the bag foil. Suitably, printing on the bag is performed prior to the fastening of the handle, the handle being produced from a transparent or single-color material.

In the bag of the invention, the handle does not occupy additional space in a coherent bag line of a plurality of bags. In this bag line, almost the complete bag length is available for generating the filling chamber. Arrangement of the handles is such that they overlap the adjacent bag, laterally project from the bag line or are sunk in a fold of the respective bag.

As a result of the attachment of the handle to a seam weld interconnecting the side walls of the bag, the tension is distributed from the handle via the seam weld to both walls of the bag. Fastening of the handle need not necessarily be performed subsequent to the application of the seam weld interconnecting the bag walls; instead, it is possible to generate this seam weld in a single welding process along with the step of fastening of the handle to the bag foil.

The foil bag of the invention can be provided as a side-folds bag or a bottom-folds bag. Particularly, this foil bag can be produced as a packing bag from a hose-shaped foil line and then be wound up into a roll.

For filling, the individual bags can be severed from the roll.

Further, the invention is directed to a foil bag line with a plurality of foil bags being arranged cohesively. According to the invention, the individual filling chambers of adjacent bags in such a bag line are separated from each other only by a seam weld, and the handles are arranged in such a manner that they do not occupy a lengthwise portion of the bag line.

Embodiments of the invention will be explained hereunder in greater detail with reference to the drawings.

BRIEF DESCRIPTION OF THE DRAWINGS

FIG. 2 is a side view of the foil bag line of FIG. 1, FIG. 3 shows one of the foil bags, detached from the line, prior to filling, FIG. 4 is a perspective view of the foil bag in the filled state, FIG. 5 shows a foil sheet from which the handles are punched out, FIG. 7 is a side view of the foil bag line of FIG. 6, and FIG. 8 is a perspective view of a filled foil bag after detachment from the foil line of FIGS. 6 and 7.

DESCRIPTION OF THE PREFERRED EMBODIMENTS

Figure 1:
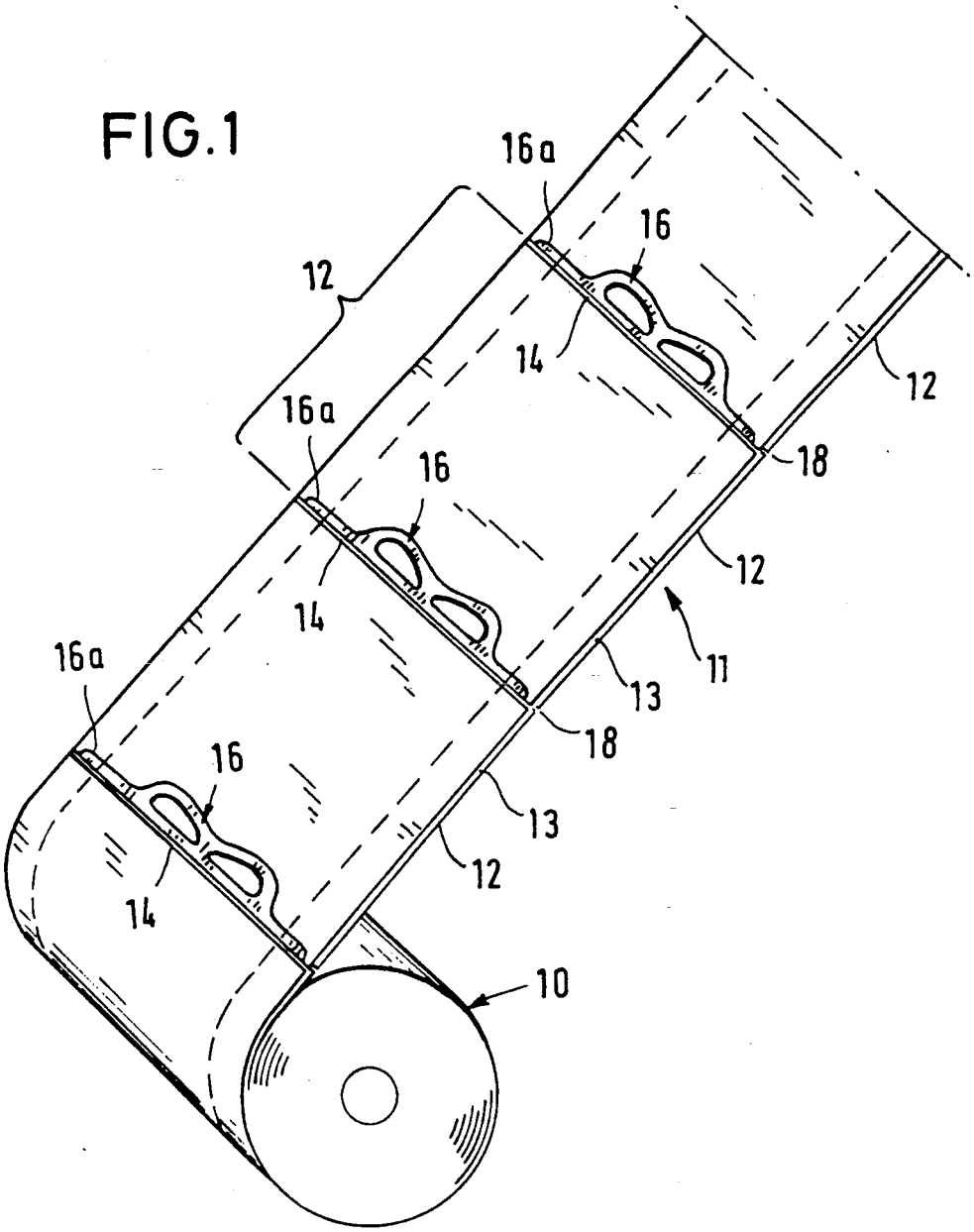
FIG. 1 shows a foil bag line consisting of side-folds bags having handles welded thereto.

FIG. 1 shows a foil bag roll 10 consisting of a line 11 of a plurality of interconnected foil bags 12. The foil bag line 11 is a hose having inwardly wrapped side folds 13, with one end of the hose set off by a transverse seam weld 14 extending over all of the four foil plies, i.e. over the foil plies of the two side walls 15 and those of the side folds 13. Welding seam 14 forms the top seam of the bag. This seam weld 14 has the ledge **16*a* of the handle 16 welded thereon. Said ledge 16*a* extends over the whole width of bag 12 so that handle 16 does not cause any differences in thickness across the bag width during movement of the bag line 11** around the rollers of a bag producing or printing machine.

The handles 16 consist of a single-layered foil material of high tensile strength. This foil material can be of larger thickness than the bags. Since, normally, the demands to be met by the outward appearance of the handles are not too high, the handles can be made from salvaged plastics material by way of recycling. The handles are punched out of a foil strip 17 as shown in FIG. 5. Each of the handles 16 consists of a linear handle ledge 16*a* according to FIG. 3 and a grip hole 16*b* provided in the central portion of said handle ledge. The central part of grip hole 16*b* can be connected to handle ledge 16*a* by a separable bridge 16*c*. This connection serves for economizing the consumption of material and the resultant waste when punching the handles from strip 17 according to FIG. 5.

In the area of the seam weld 14, as best shown in FIG. 2, the handle ledge 16*a* of each handle 16 is welded to the outboard side of side wall 15 in such a manner that the grip hole 16*b* protrudes beyond the front end of bag 12 and overlaps the rear end of the preceding bag. Successive bags 12 are detached from each other by tearoff seams or perforations. These tear-off seams 18 are located in the vicinity of a seam weld 14, respectively.

Figure 6:
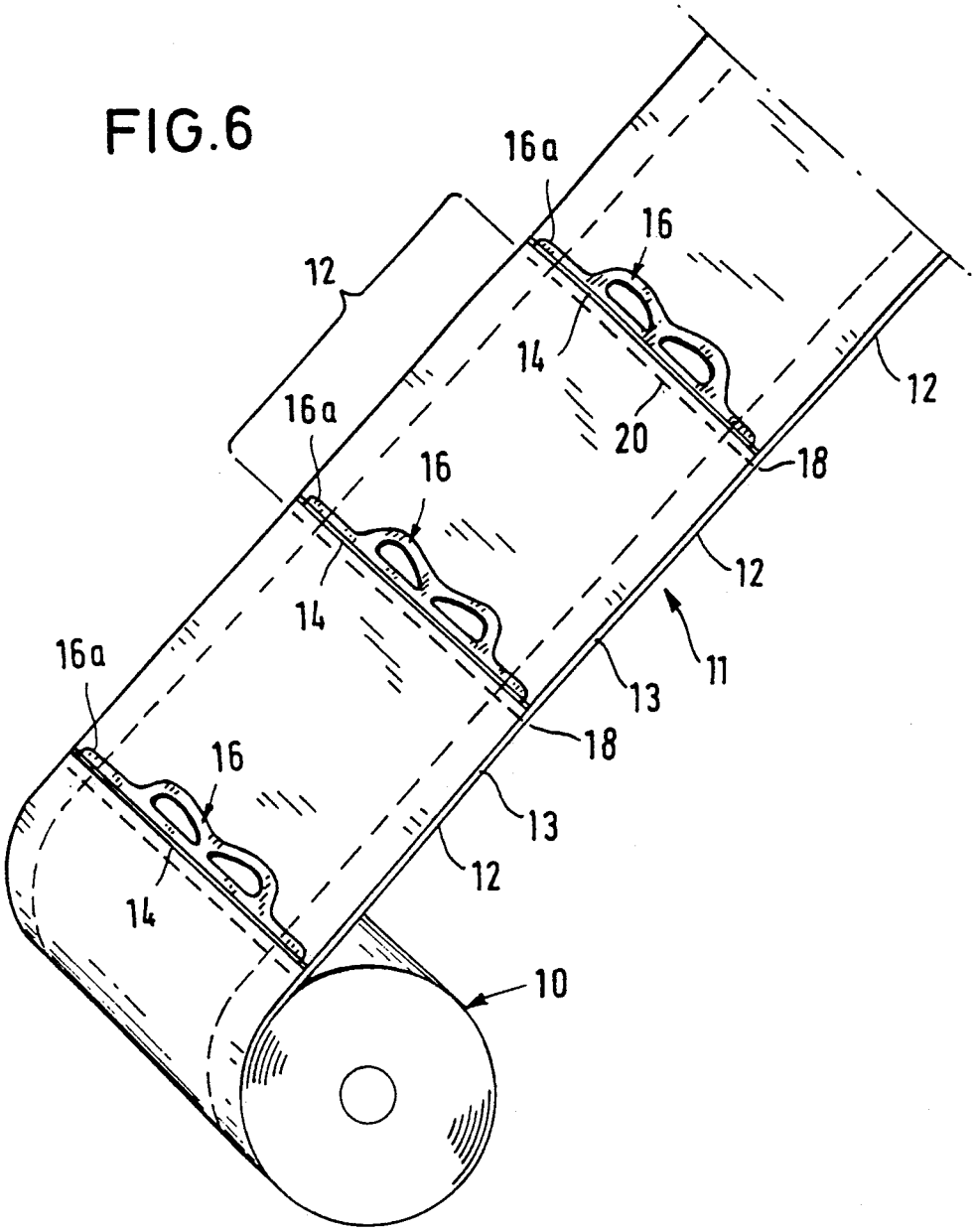
FIG. 6 shows a second embodiment of the foil bag line consisting of side-folds bags having handles welded thereto.

The embodiment of FIGS. 6 to 8 largely corresponds to the above first embodiment so that the description thereof will be restricted to the differences between the two embodiments. In the second embodiment, the handle 16 is lying flat on the appertaining bag 12. Handle 16 consists of a separate foil portion extending from seam weld 14 in the direction of that bag end 20 which is averted from seam weld 14. On this bag end 20, a tear-off line 18 or perforation is arranged for sep-arating bag 12 from the adjacent bag. Thus, handle 16 does not overlap the adjacent bag but, instead, the bag to which it is attached. Handle 16 rests flat on the side wall 15 of this bag and is directed towards the rearward bag end 20.

Individual bags 12 are separately torn off the bag line of FIGS. 6 and 7 and then are filled through the open mouth 12 of the respective bag.

FIG. 8 shows a completed and filled bag, with its bag end 20 having been closed after filling by a further transverse seam weld 21. The handle portion 16, welded to seam weld 14, rests on the one half of the upper side 22 of the bag while seam weld 14 is pressed against the other half of said upper side. Thus, handle 16 lies flat on upper side 22 so that the filled bags can be stacked onto each other. When gripping the han-dle 16 and lifting the bag, the flexible handle 16 takes on its upright position.

Although a preferred embodiment of the invention has been specifically illustrated and described herein, it is to be understood that minor variations may be made in the apparatus without departing from the spirit and scope of the invention, as defined the appended claims.

i claim:

1. A bag line comprising a generally tubular body having opposite sides and opposite ends and a medial portion between said opposite ends; said tubular body further being defined by a side gusset at each of said opposite sides, a front panel and a rear panel; each side gusset being defined by a pair of gusset panels joined to each other along a first line and joined to said front and rear panels at respective second and third lines; said tubular body being of a generally flattened configuration with said pairs of gusset panels being sandwiched between said front and rear panels; said first lines of said opposite side gussets being closer to each other than said second and third lines of said opposite side gussets whereby said side gussets each open in a generally outward direction during opening of said tubular body from its generally flattened configuration; a handle transversing said medial portion generally between said opposite ends; means for transversely welding said handle to one of said front and rear panels at said medial portion and for transversely welding each pair of gusset panels to each other and one each to said front and rear panels at said medial portion and portions of said front and rear panels between said gusset panels to each other, and an end of each tubular body adjacent a handle of an adjacent tubular body defining a filling opening of each adjacent tubular body.

2. The bag line as defined in claim 1 wherein said transversely welding means sets-off a first bag portion from a second bag portion, said first bag portion includes said transversely welding means and said second bag portion excludes said transversely welding means, a transverse tear-off line adjacent said transversely welding means for separating said first and second bag portions from each other, said handle is welded to said first bag portion by said transversely welding means, and a portion of said handle projects into overlying relationship to said second bag portion.

3. The bag line as defined in claim 1 wherein said transversely welding means sets-off a first bag portion from a second bag portion, said first bag portion includes said transversely welding means and said second bag portion excludes said transversely welding means, a transverse tear-off line adjacent said transversely welding means for separating said first and second bag portions from each other, said handle is welded to said first bag portion by said transversely welding means, and said handle projects in a direction away from said second bag portion.

4. The bag line as defined in claim 1 wherein said transversely welding means sets-off a first bag portion from a second bag portion, said first bag portion includes a transversely welding means and said second bag portion excludes said transversely welding means, a transverse tear-off line adjacent said transversely welding means for separating said first and second bag portions from each other, said handle is welded to said first bag portion by said transversely welding means, and said handle projects in a direction toward said second bag portion.

5. A bag line comprising a generally tubular body having opposite sides and opposite ends and a medial portion between said opposite ends; said tubular body further being defined by a side gusset at each of said opposite sides, a front panel and a rear panel; each side gusset being defined by a pair of gusset panels joined to each other at a first edge portion and joined to said front and rear panels at respective second and third edge portions; said tubular body being a generally flattened configuration with said pairs of gusset panels being sandwiched between said front and rear panels; said first edge portions of said opposite side gussets being closer to each other than said second and third edge portions of said opposite side gussets whereby said side gussets each open in a generally outward direct during opening of said tubular body from its generally fattened configuration; a handle substantially transversing said medial portion generally between said opposite ends; means for transversely welding said handle to one of said front and rear panels at said medial portion and for transversely welding each pair of gusset panels to each other and one each to said front and rear panels at said medial portion and portions of said front and rear panels between said gusset panels to each other, and an end of each tubular body adjacent a handle of an adjacent tubular body defining a filling opening of each adjacent tubular body.

6. The bag line as defined in claim 5 wherein said transversely welding means sets-off a first bag portion from a second bag portion, said first bag portion includes said transversely welding means and said second bag portion excludes said transversely welding means, a transverse tear-off line adjacent said transversely welding means for separating said first and second bag portions from each other, said handle is welded to said first bag portion by said transversely welding means, and a portion of said handle projects into overlying relationship to said second bag portion.

7. The bag line as defined in claim 5 wherein said transversely welding means sets-off a first bag portion from a second bag portion, said first bag portion includes a transversely welding means and said second bag portion excludes said transversely welding means, a transverse tear-off line adjacent said transversely welding means for separating said first and second bag portions from each other, said handle is welded to said first bag portion by said transversely welding means, and said handle projects in a direction away from said second bag portion.

8. The bag line as defined in claim 5 wherein said transversely welding means sets-off a first bag portion from a second bag portion, said first bag portion includes said transversely welding means and said second bag portion excludes said transversely welding means, a transverse tear-off line adjacent said transversely welding means for separating said first and second bag portions from each other, said handle is welded to said first bag portion by said transversely welding means, and said handle projects in a direction toward said second bag portion.

* * * * *